United States Patent [19]

Hanlet

[11] 4,414,492

[45] Nov. 8, 1983

[54] ELECTRONIC BALLAST SYSTEM

[75] Inventor: Jacques M. Hanlet, Loxahatchee, Fla.

[73] Assignee: Intent Patent A.G., London, England

[21] Appl. No.: 344,155

[22] Filed: Feb. 2, 1982

[51] Int. Cl.[3] ..... H05B 37/00

[52] U.S. Cl. ..... 315/290; 315/98; 315/119; 315/207; 315/219; 331/113 A

[58] Field of Search ..... 315/219, 221, 243, 289, 315/207, 119, 98, 290; 331/113 A

[56] References Cited

U.S. PATENT DOCUMENTS

| | | | |
|---|---|---|---|
| 3,247,422 | 4/1966 | Schultz | 331/113 A |
| 3,396,307 | 8/1968 | Campbell | 315/221 |
| 3,579,026 | 5/1971 | Paget | 331/113 A |
| 3,766,467 | 10/1973 | Reising | 331/113 A |
| 3,769,545 | 10/1973 | Crane | 331/113 A |
| 3,882,354 | 5/1975 | May | 315/221 |
| 4,145,636 | 3/1979 | Doi | 315/221 |

*Primary Examiner*—Harold Dixon

*Attorney, Agent, or Firm*—Morton J. Rosenberg

[57] ABSTRACT

An electronic ballast system includes a first capacitor ($C_2$) electrically coupled to the first filament (30) of a gas discharge tube (12) and becomes the power supply of the gas discharge tube (12) subsequent to both its charging and discharging operations. The collector (38) of a transistor (Tr) is connected to the first capacitor ($C_2$). The primary winding (22) is connected to the first capacitor ($C_2$) and the collector (38) of the transistor (Tr) in parallel relation. The transformer (t) includes a secondry winding (24) which is connected on opposing ends thereof in feedback relation to the base (44) and emitter (42) of the transistor (Tr). Pulses of opposing current polarity (122 and 124) generated through the secondary winding (24) alternately provide conducting and non-conducting states for transistor (Tr) to discharge and charge the first capacitor ($C_2$) through gas discharge tube (12) to provide a power source for operation of gas discharge tube (12). The combination provides voltage limiting preventing the kick back voltage from the primary winding (22) to exceed a safe operating limit of the transistor (Tr) and allows use of the energy to produce visible light output instead of heat.

36 Claims, 8 Drawing Figures

T0
T1
T2
118
112
108
106
104
114
120
102
122
124
116
110
128
126
170 V.
0V.
70V.
-70V.
1 V.
-1.5V.
0 200ma.
8 ma.
0
-12 ma.
6V.
0
- 6V.
100ma.
0
-110ma.

ELECTRONIC BALLAST SYSTEM

BACKGROUND OF THE INVENTION

1. Field of the Invention

This invention pertains to an electronic ballast system for gas discharge tubes. In particular, this invention relates to an electronic ballast system for fluorescent light sources which provides a high efficiency in transforming electrical energy into the visible bandwidth of the electromagnetic spectrum. More in particular, this invention directs itself to a transistorized electronic ballast system for fluorescent light sources. Still further, the subject invention concept provides an electronic circuit for fluorescent light sources which converts sinusoidal energy into rectangular pulses having a low duty factor at ultrasonic frequencies. Additionally, the subject invention relates to a transistorized electronic ballast system which reduces the use of electrical energy by as much as 50% with respect to some other commercially available ballast systems while maintaining substantially the same light output. Further, the subject electronic ballast system is directed to a system which minimizes weight, volume, and component elements to increase reliability, adaptability to currently available fluorescent tubes and minimizes manufacturing costs. Still further, the subject electronic system provides a unique circuitry where the gas discharge tube is incorporated within the circuit to provide the dual role of producing visible light as well as to dampen oscillations produced in the primary winding of a transformer when its current is interrupted as the transistor is switched to an "off" mode.

2. Prior Art

Ballast systems for gas discharge tubes and fluorescent light bulbs in particular are known in the art. However, in some prior art ballast systems, such operate at relatively low frequencies in the order of twice the line or power source frequency. Such prior art ballast systems have the disadvantage of providing a flicker type effect.

In other prior art ballast systems, the duty cycle of the electronic components is relatively high. Thus, such has led in the past to overheating of the electronic components contained within the ballast system and has caused failure of such prior art ballast systems over relatively shortened lifetimes.

In other prior art ballast systems, the number of components contained within the circuit is relatively large. This large number of components has led to such prior art ballast systems having a relatively large volume. The large volume has been due in part to the number of electronic components in such prior art ballast systems in combination with components used for dissipation of heat due to the disadvantageous thermal effects resulting from the high duty cycles.

In many prior art type ballast systems, the number of electrical components is high which results in a generally lower reliability as well as an increased manufacturing cost including additional labor costs.

Other types of prior art ballast systems generally operate at relatively low frequencies and have a low operating efficiency, which provides for approximately one-half the visible light output found in the subject invention electronic ballast system for the substantially the same electrical power input.

In some prior art systems an electronic ballasting system using transistor elements is provided. However, in some such prior art systems, a coil is used in series with a capacitor to supply the energy to the fluorescent system. Thus, in such prior art systems, the core must produce the charge/discharge of the overall system, but does not contribute to the energy that serves to drive the fluorescent tube and produce the visible light. In some such prior art systems, the electrical energy expenditure is increased due to the fact that energy must be supplied during the interval of the pulses in order that the plasma within the fluorescent tube does not become extinguished. Additionally, such prior art systems rely on saturation of the transformer magnetic core and the transistor to obtain an undriven square wave power oscillator converter. In such cases, the "on" time of the transistor is determined by the voltage induced in the secondary winding which is fixed by the transformer as well as the combination of the supply voltage and the turn ratio between the primary winding and secondary winding of the transformer. However, in such cases, the current is applied to the base of the transistor has substantially the same wave shape as the voltage pulse produced at the primary winding with the exception that at the instant of saturation, the transformer primary impedance quickly drops to substantially a zero value. This drop in impedance causes a steep rise in the collector current which results in a high collector current spike at the end of the conducting cycle which causes increased energy dissipation.

SUMMARY OF THE INVENTION

An electronic ballast system connected to an AC power source for a gas discharge tube having a first and second filament. The electronic ballast system includes a first capacitor electrically coupled to the first filament of the gas discharge tube. A transistor having a base, emitter and collector is included in the electronic ballast system circuit with the collector of the transistor being coupled to the first capacitor. A transformer having a primary winding coupled on opposing ends to the AC power source and in parallel relation with the first capacitor and the collector of the transistor. A secondary winding of the transformer is coupled on opposing ends thereof in positive feedback relation to the base of the transistor and the emitter of the transistor.

DESCRIPTION OF THE PREFERRED EMBODIMENTS

Figure 1:
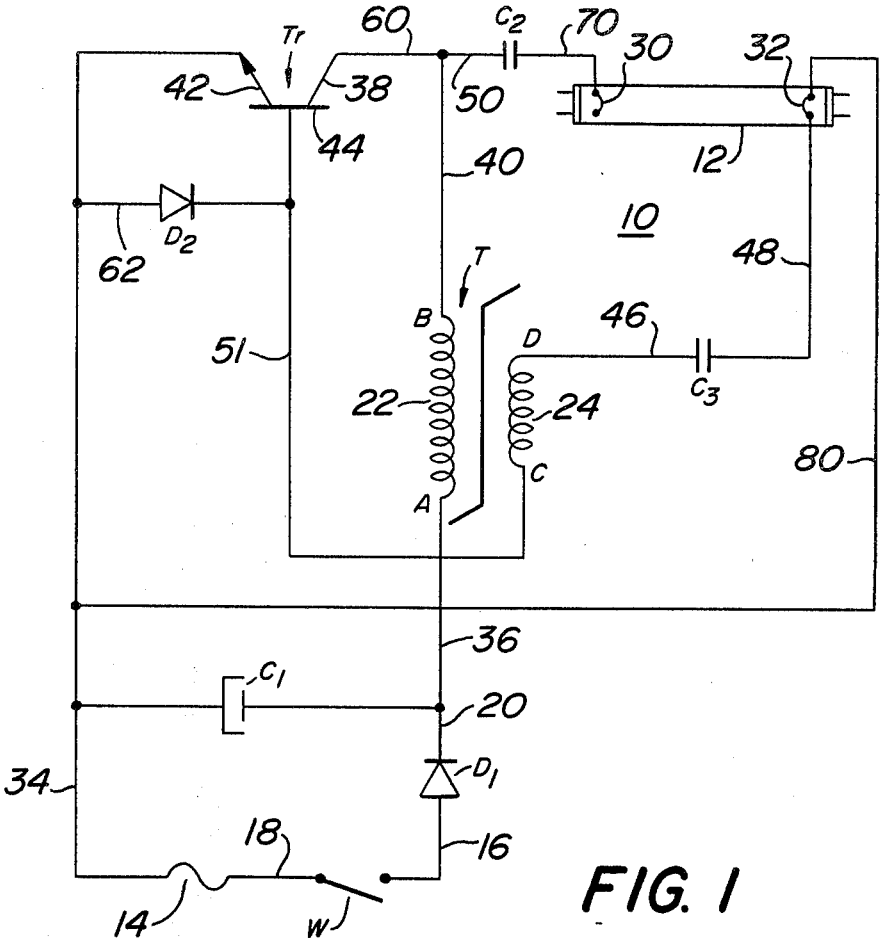
FIG. 1 is an electrical schematic diagram of the electronic ballast system.

Referring now to FIG. 1, there is shown electronic ballast system 10 for operation of gas discharge tube 12, which may be a standard fluorescent tube to be further described in following paragraphs. As will be detailed, gas discharge tube 12 is an integral part of the circuitry associated with electronic ballast system 10. In overall concept, electronic ballast system 10 provides for a maximization of operating efficiency for gas discharge tube 12. System 10 minimizes the number of manufacturing components, which results in a lower overall manufacturing cost and increases the lifetime reliability of electronic ballast system 10. Additionally, system 10 operates at an extremely high frequency when taken with respect to prior art fluorescent lighting systems. Such prior art fluorescent lighting systems operate at approximately twice the line frequency, or approximately 120 cycles. The subject electronic ballast system 10 operates at approximately 20,000 cycles which provides the advantage of minimizing any type of flicker effect. Further, with the high frequency of operation, the average light output of gas discharge tube 12 is substantially greater than that provided by prior art fluorescent lighting systems for a particular power source output. Further, as will be seen in following paragraphs, the duty cycle of system 10 is minimized and thus, reliability is increased when taken with respect to the electronic components contained therein. Further, with a low duty cycle as provided in the subject electronic ballast system 10, temperature gradients and temperature increases of the electronic components are minimized when taken with respect to prior art ballast systems. The minimization of temperature effects increases the overall reliability of ballast system 10 in that overheating problems are minimized.

Referring now to FIG. 1, AC power source 14 is electrically coupled to switch W through power source output line 18. AC power source 14 for purposes of this disclosure, may be considered to be a standard 120 volt AC power source standardly found in most residental power systems. It is to be understood that AC power source 14 may be a 220 volt AC power source or other power source, however, the basic invention concept as detailed in following paragraphs remains the same independent of the power source although electrical component parameters may change. The 120 volt AC power source is used herein for illustration purposes. Switch W may be a standard off/on type switch, used merely for closing the overall circuit and coupling electrical line 16 to line 18 when closed. Diode input line 16 is connected to the anode side of diode $D_1$, which is a commercially available diode. One such diode has the commercial designation 1N4004. Diode $D_1$ functions as a conventional half-wave rectifier to provide half-wave rectification of the AC signal coming in on line 16, where such half-wave rectification is output on line 20 on the cathode side of diode $D_1$.

Capacitor $C_1$ is connected on opposing ends thereof to the output of diode $D_1$ and return power source line 34. Thus, capacitor $C_1$ is connected in parallel with diode $D_1$ and AC power source 14, as is clearly seen in the schematic diagram. For purposes of this disclosure, capacitor $C_1$ has a value approximating 100 microfarads, and functions as a filter which charges during the half-cycle that diode $D_1$ passes current and discharges during the remaining portion of the cycle. Thus, the voltage being input to transformer T on line 36 is a DC voltage having a small ripple at line frequency where the amplitude of such ripple does not exceed approximately 8.0% of the value adopted for capacitor $C_1$.

The pulsating DC current is applied to transformer T on transformer primary input line 36. Transformer T is a ferrite core type transformer and has the characteristics of allowing the core to saturate relatively early in the voltage rise time and fall time of each pulse across primary winding 22. The secondary voltage pulse amplitude is limited to a predetermined value by the turns ratio of primary and secondary windings 22 and 24. However, it is to be understood that the energy to base 44 of transistor Tr is a function of both the voltage ratio and the differentiation of capacitor $C_3$ and the resistance of second filament 32. Primary winding 22 includes terminals A and B and secondary winding 24 has associated therewith terminals C and D. The specific transformer T being used in electronic ballast system 10 is conventional in nature and for purposes of this disclosure, primary winding 22 is formed of 160 turns of number AWG 28 wire wrapped around a ferrite core. Secondary winding 24 of transformer T is formed of approximately 18 turns of AWG number 28 wire. As shown in the schematic diagram FIG. 1, transformer T is phased in such a manner such that as a voltage charge appears between terminal B with respect to terminal A of primary winding 22, there is produced a proportional voltage change between terminals C and D of secondary winding 24 of transformer T, however, this proportional voltage change is of opposite polarity as measured between lines 51 and 34. Thus, when a voltage increase is applied to collector 38 of transistor Tr, a voltage of opposite polarity is applied to base 44 of transistor Tr.

The output of primary winding 22 from terminal B on line 40 is coupled to collector 38 of transistor Tr on line 60. Additionally, primary winding 22 is similarly coupled to capacitor $C_2$ through line connections 40 and 50. Thus, this type of coupling provides for parallel paths for current exiting primary winding 22 for purposes and objectives to be seen in following paragraphs.

Transistor Tr is a commercially available transistor of the NPN type. Transistor Tr includes collector 38, base 44 and emitter 42. One particular transistor Tr which has been successfully used in electronic ballast system 10 is a commercially available MJE13002 produced by Motorola Semiconductor, Inc. Transistor Tr operates as a switch in ballast system 10 and the current path through transistor Tr is provided when the voltage of base 44 to emitter 42 is greater than 0.7 volts for the particular transistor Tr being disclosed. The 0.7 voltage drop of base 44 to emitter junction 42 is typical of this type of silicon transistor Tr.

Current flow through a second path from terminal B of primary winding 22 passes through line 50 into first capacitor $C_2$. First capacitor $C_2$ is a commercially available capacitor having a value approximating 0.050 microfarads. As is the usual case, as current passes through primary winding 22 of transformer T, first capacitor $C_2$ is charged to the voltage available at terminal B. Output from first capacitor $C_2$ is provided on first capacitor output line 70 to one end of gas discharge tube first filament 30. When first filament 30 is positive with respect to second filament 32, electrons are attracted to filament 30, and obviously when filament 30 is negative, electrons are emitted, when negative filament 30 is heated by ion bombardment. When transistor Tr is "on", first and second filaments 30 and 32 are respectively a cathode and an anode, when transistor Tr is "off", first filament 30 is an anode and second filament 32 is a cathode. Initially, as base 44 becomes more positive, current flows from emitter 42 to collector 38. This makes output line 40 more negative than terminal A which is seen to be the pulse at $T_0$ on FIG. 2A. At the same time, current flows from first filament 30 through tube 12, second filament 32, line 80, emitter 42, collector 38 into line 60 and 50 to capacitor $C_2$. Thus, first filament 30 acts as a cathode connection during this phase of the cycle.

Gas discharge tube 12 may be a standard fluorescent tube which is commercially available. One such type tube bears the designation F20T12/CW 20 watt lamp. As can be seen, gas discharge tube 12 becomes an integral part of the overall circuit of electronic ballast system 10. Second filament 32 is coupled to return power source line 34 of AC power source 14 through electrical line 80. Thus, during this phase of the lighting cycle, second filament 32 acts as an anode for gas discharge tube 12. As is evident, the discharging current of first capacitor $C_2$ flows through gas discharge tube 12 which has a high resistance during the initial phases of the lighting cycle. Specifically, gas discharge tube 12 of the aforementioned type has a resistance of approximately 1100 ohms.

Second filament 32 in opposition to first filament 30 does have a measurable current flowing therethrough which is used to heat filament 32 by Joule Effect and provides an aid in ionization of the contained gas in gas discharge or fluorescent tube 12. Current flowing through second filament 32 is provided by secondary winding 24 of transformer T. In the transformer T being used, secondary winding 24 is 18 turns of number 28 wire wound on the ferrite core, as previously described for primary winding 22. Terminal D of secondary winding 24 is coupled to second capacitor $C_3$ through line 46. Current on line 46 is differentiated by capacitor $C_3$ and exits on line 48 which is coupled directly to second filament 32, as shown in FIG. 1. Second capacitor $C_3$ also acts to establish the desired duty cycle by the resonant frequency of the inductance of secondary winding 24 coupled to capacitor $C_3$.

Returning to secondary winding 24 of transformer T, it is noted from FIG. 1 that secondary winding 24 is phased with respect to primary winding 22 in a manner such that as voltage increases across primary winding 22 from terminal A to terminal B, the voltage at the secondary winding 24 is provided such that terminal C increases with respect to terminal D.

Figures 2A, 2B, 2C, 2D, 2E, 2F, 2G:
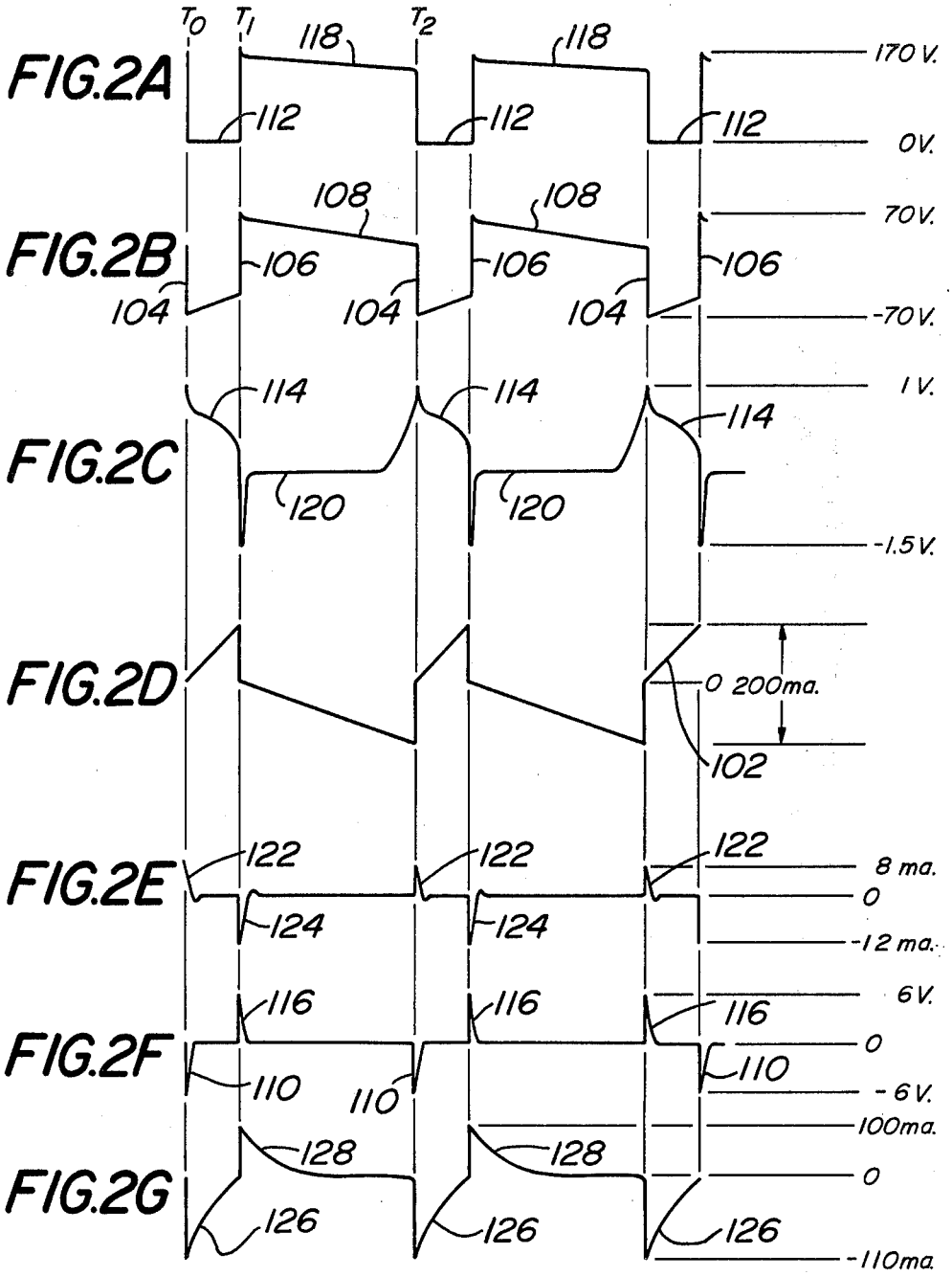
FIG. 2A is a graph showing the voltage difference between the collector and the emitter of the transistor throughout a plurality of time cycles.
FIG. 2B is a graph showing the voltage potential across the load including the gas discharge tube measured between input and output lines of the gas discharge tube throughout a plurality of charge/discharge cycles.
FIG. 2C is a graph showing the voltage between the base and the emitter of the transistor throughout a plurality of cycles.
FIG. 2D is a graph showing the current flow in the lead line coupled to the first diode and the first capacitor during charge and discharging stages of a plurality of cycles.
FIG. 2E is a graph showing current pulses applied to the base of the transistor and a second diode during a plurality of cycles.
FIG. 2F is a graph showing the pulse voltage differentiated through a differentiating capacitor and applied across the second filament of the gas discharge tube providing for opposing pulse polarity signals during a plurality of cycles; and, FIG. 2G is a graph showing the current flowing through the gaseous plasma of the gas discharge tube.

Current passing through second filament 32 is brought back to secondary winding terminal C of secondary winding 24 through secondary filament output line 80 through either diode element $D_2$ or the base emitter junction defined by elements 42 and 44 of transistor Tr, and then back through line 51 to terminal C of secondary winding 24. Diode $D_2$ is a commercially available diode element, one such being used is Model No. IN4001. Determination of whether current passes through diode $D_2$ or transistor Tr is made by the polarity of the secondary voltage of secondary winding 24. Thus, there is a complete current path during each half-cycle of the secondary voltage being produced. As shown in FIG. 2C, with the cathode of diode $D_2$ back biased by the positive pulse, such draws no current. Thus, only the energy within differentiated pulse 122 of FIG. 2E determines the current flowing through base 44 of transistor Tr, which depends on the rate of differentiation of capacitor $C_3$ and the resistance of second filament 32. In the transistor "on" portion of the cycle, current passes through line 80 into emitter 42, to line 51 and finally into terminal C corresponding to current line 122 of FIG. 2E. During the leading edge of pulse 124, diode $D_2$ is conducting which brings base 44 to a potential more negative than emitter 42 which switches transistor Tr to the "off" mode. In this half of the cycle, the current path passes from terminal C, through line 51 and diode $D_2$ returning through line 62 into line 80 and then back to terminal D through second filament 32 and capacitor $C_3$.

For possible ease of understanding electronic ballast system 10, the overall system may be considered as having a primary circuit and a secondary circuit. The primary circuit provides for a charging current through gas discharge tube 12 between first and second filaments 30 and 32. The primary circuit includes primary winding 22 of transformer T with primary winding 22 being electrically coupled on opposing ends to first filament 30 and AC power source 14. In detail, the primary circuit may be seen from FIG. 1 to provide a path from AC power source 14 through diode $D_1$ through primary winding 22 of transformer T into first capacitor $C_2$. Additionally, the current path from first capacitor $C_2$ passes into first filament 30, through the resistance of tube 12, into filament 32, and passes into output line 80 and finally into return line 34 and AC power source 14. The primary circuit provides for a source of alternating positive and negative voltage pulses having differing amplitudes. When the positive pulse is applied to base 44 of transistor Tr from the secondary circuit, transistor Tr is turned "on". Collector 38 is quickly brought to the potential of emitter 42 and line 34 since there is substantially little resistance between emitter 42 and line 34. Current then flows from line 34 through transistor Tr to line 36. This induces a voltage drop across primary winding 22 opposing the applied voltage from terminal A with terminal B being more negative than terminal A. The magnetic lines of force created by the current moves outward from the core of transformer T.

The drop of voltage across primary winding 22 is substantially equal to the potential difference between lines 36 and 34 due to the fact that collector 38 is substantially at the potential of emitter 42. At the termination of the pulse time defined by the interval $T_1$- $T_0$, the initial current at $T_0$ drops to approximately 80.0%, as shown by pulse line 126 of FIG. 2G when measured between first filament 30 and line 80.

As transistor Tr ceases to conduct at $T_1$ due to the negative potential applied to base 44, the DC current falls to substantially a zero value and the negative lines of force collapse back toward the coil which induces a voltage. The direction of the voltage is such as to try to maintain the same direction of current flow as previously described, due to the fact that the induced voltage makes primary winding 22 act as the source in which case the current flows from positive to negative within the source.

Thus, terminal B now becomes more positive than terminal A. Ordinarily, the induced voltage value L di/dt would make this voltage greater than the source on lines 34, 36, however, very importantly, the gas discharge in tube 12 between first and second filaments 30 and 32 becomes a bi-directional voltage limiter. Thus, tube 12 acts as if tube 12 were constructed of two Zener diodes in back-to-back relation, thus preventing deleterious effects on transistor Tr caused by large voltage peaks. Tube 12 thus produces light with energy which would otherwise have been dissipated as heat.

When transistor Tr is in the "off" mode, there is a singular path of current flow between the time interval $T_2$-$T_1$. Transistor Tr does not draw current from the charge of capacitor $C_2$ by the voltage pulse L di/dt and the source line 36. With line 50 more positive than line 70, first filament 30 becomes an anode and second filament 32 a cathode for the time of discharge of the current represented by pulse contour 128 of FIG. 2G.

The secondary circuit for actuating the primary circuit and transistor Tr, and controlling gas discharge in gas discharge tube 12, includes secondary winding 24 of transformer T coupled to second capacitor $C_3$ and second filament 32. The path of current of the secondary circuit passes through output filament line 80 through either diode $D_2$ or transistor Tr into line 51 and then into terminal C of secondary winding 24.

In overall operation, electronic ballast system circuitry 10 provides for sufficient electrical discharge within gas discharge tube 12 for transforming electrical energy from power source 14 into a visible light output. Thus, the energy discharged in the interval time $T_2$-$T_1$ corresponds to the nominal voltage of gas discharge tube 12. Prior to a first closure of switch W, there is obviously no potential drop across any portion of ballast system 10, thus, as in all other portions of the overall circuit, the potential difference across transistor Tr and between lines 40 and 70 is substantially a zero value.

Upon an initial closure of switch W, AC power source 14 provides a current flow in electronic ballast circuit 10 which is half-wave rectified by diode $D_1$ connected within lines 16 and 20, as is shown in FIG. 1. Condenser or filter means $C_1$ is coupled between line 20 and return supply line 34 in parallel coupling with AC power source 14. Filter or capacitor $C_1$ charges during the halfcycle that diode $D_1$ passes current, i.e., during the positive half cycle on line 16, and is reverse biased during the other half preventing discharge back to source 14. Thus, on line 36 being input to primary winding 22 of transformer T, there is a pulsating DC current.

At this time, transistor Tr is not biased and there is not sufficient potential differential to cause a discharge in gas discharge tube 12. The resistance of collector 38 to emitter 42 of transistor Tr is extremely high, being for practical purposes, infinite, with the exception of a small leakage. Transistor Tr for all practical purposes, has no voltage on base 44 and emitter 42, and thus, transistor Tr is in an "off" state and no current flows from emitter 42 to collector 38. The only current that flows is charging of capacitor $C_2$ through lines 40 and 50. The current flows through capacitor $C_2$, to line 36, then through primary winding 22 and is small and insufficient to induce a voltage in secondary winding 24 of transformer T.

Transformer T is a ferrite core type transformer, and is used due to the fact that in this type of transformer T, the core becomes saturated in a rapid manner using less than one-tenth of the current needed to energize tube 12. Thus, the core transmits the maximum magnetic flux to secondary winding 24 prior to the voltage reaching its peak value on primary winding 22. Prior to saturation, the difference in secondary voltage is obtained as the primary voltage continually increases. Capacitor $C_2$ charges at a rate determined by the capacitance value and resistance in gas discharge tube 12 which for tube 12 approximates 1100 ohms during the gas discharge and is greater prior to discharge, as is found in the F20T12/CW 20 watt lamp being used for purposes of this disclosure.

When switch W is then opened and closed for a second time, an impulse or secondary pulse is produced through primary winding 22. The impulse provides for a current change on primary winding 22 which is large and secondary winding 24 generates a current sufficient in the ultimate passage of current through circuit 10 to turn transistor Tr into an "on" state. With transistor Tr turned to the "on" state, the voltage drop across collector 38 to emitter 42 is extremely small and capacitor $C_2$ on line 50 is coupled to supply line 34 through lines 60 and transistor Tr.

Capacitor $C_2$ has been charged positively on line 50 and negatively on line 70 up to this point. A negative current is now output since capacitor $C_2$ is coupled to return line 34 through line 60 and transistor Tr. Since there is a negative output on line 70, filament 30 becomes a cathode. Second filament 32 which is at the potential of the return side of power supply 14, thus becomes an anode. At this time, capacitor $C_2$ becomes the current source for gas discharge tube 12 since one end of capacitor $C_2$ is coupled to return line 34 through lines 50, 60 and transistor Tr and the opposing end of $C_2$ is coupled to discharge tube 12 through first filament 30, and the return path from filament 32 of gas discharge tube 12 to return line 34.

The end of capacitor $C_2$ coupled to line 50 was charged positively and is at this time, coupled to return line 34. Negative current is applied to discharge tube 12 on line 70 and the voltage produced is greater than the approximate 85.0 volts which for this tube 12 is the breakdown voltage, there is produced the usual light output. As is evident, the plasma within gas discharge tube 12 is effectively an electrical resistor. The temperature of filaments 30 and 32 of gas discharge tube 12 are maintained at a sufficiently high value to insure emission of electrons as long as the pulses of voltage are applied from capacitor $C_2$. In the gas discharge tube 12, as used in this disclosure with a 20.0 watt dissipation, the electrical resistance of tube 12 approximates 1100 ohms. Thus, the time constant of capacitor $C_2$ in series with tube 12 represents a time constant approximating 50.0 microseconds.

Secondary winding 24 of transformer T provides for a differentiated signal through capacitor $C_3$ to the base 44 of transistor Tr. Thus, a narrow pulse is supplied to transistor Tr and once transistor Tr is turned to the "on" state, the current in secondary winding 24 will become substantially zero and place transistor Tr in the "off" state. The cycle is then repetitive and capacitor $C_2$ again charges as previously described.

Going back in the cycle, as the case of transformer T is being saturated, a potential is applied across diode $D_2$ which is a positive pulse of voltage which is also applied across the base to emitter junction of transistor Tr. This positive pulse is due to the fact that line 40 to transformer T is at a lower voltage than line 36.

Thus, there is a positive signal pulse on line 51 generated from secondary winding 24.

Due to the fact that diode $D_2$ is reverse biased, it does not conduct when line 51 is positive. The base emitter junction is forward biased and conducts current and limits the voltage drop between lines 51 and 62 which for ballast system 10, approximates 1.0 volts. Transistor Tr then goes to an "on" state and during the "on" state of transistor Tr, voltage in secondary winding 24 is induced with a potential on line 40 being approximately zero.

When transistor Tr comes out of saturation, line 51 becomes negative. This now forward biases diode $D_2$ and reverse biases the base emitter junction of transistor Tr. Secondary current flows through diode $D_2$ and the voltage across diode $D_2$ is clamped at minus 1.5 volts on line 51 with respect to line 62. Line 40 goes from substantially a zero value to a positive level. Thus, once again, current flows between lines 40 and 36 and a pulse of positive polarity is applied to line 70 across capacitor $C_2$. The positive polarity pulse is applied to first filament 30 of gas discharge tube 12 and the plasma ignition is maintained.

It is to be understood that a subsequent resistor may be placed between lines 40 and 51 of the diagram shown in FIG. 1. With the placement of a subsequent resistor, the pulse necessary to be input to secondary winding 24 will be accomplished through a singular closing of switch W. Thus, with the insertion of a subsequent resistor between lines 40 and 51, once saturation has occurred in transformer T, a pulse is provided for initiation of the overall cycle of ballast system 10.

Referring now to FIGS. 2A–2H, there is shown the timing diagrams and associated wave voltage and current waveforms for electronic ballast system 10. The abscissa of each of the graph waveforms is a time parameter with $T_0$ being the time of transistor Tr being turned "on". The time differential represented between $T_0$ and $T_1$ is the time interval during which transistor Tr is in the "on" state, which as previously described, is a function of the inductance of secondary winding 24 and the capacitance value of capacitor $C_3$. The time interval between $T_1$ and $T_2$ is the interval of the overall cycle within which transistor Tr is in the "off" state, which is a function of the time constant of capacitor $C_2$ multiplied by the resistance of the plasma. One full cycle consists of the time interval between $T_2$ and $T_0$. Overall electronic ballast circuit system 10 operates at approximately 20,000 cycles per second. The time interval between $T_0$ and $T_2$ approximates 40–50 microseconds with the time interval between $T_0$ and $T_1$ being approximately 8–10 microseconds.

Referring now to FIG. 2A, such represents the voltage on line 40 of FIG. 1. Initially, at $T_0$, transistor Tr is placed in the "on" state and the voltage from collector 38 to emitter 42 drops from an initial approximate 170.0 volts to approximately zero volts. During transistor Tr "on" state, such voltage remains at approximately zero for the time interval $T_0$ to $T_1$.

At $T_1$, transistor Tr is turned "off" and the collector to emitter voltage increases to several times the DC voltage of the source. The collector to emitter voltage results from the energy stored in primary winding 22 during the "on" state of transistor Tr is substantially equal to $L^{di}/dt$. Thus, with the previously described small time constant of the "off" condition, a voltage of 800 volts or more may be produced. This voltage surge must be clamped to a safe level to avoid deleterious effects on transistor Tr. Usually, fast recovery diodes and/or combinations of resistors and capacitors commonly called snubbers are used for the clamping. However, such dissipates the excess energy stored in the coil as heat which is a disadvantage. In the subject system 10, the combination of capacitor $C_2$ and the internal resistance of the plasma acts as a voltage limiter where the dissipation of energy is used to produce light instead of heat. Thus, the plasma acts as a diode is series with a resistance approximating 1100 ohms which clamps the voltage between line 70 and second filament 32 to plus or minus approximately 70.0 volts.

The voltage on line 40 remains essentially constant but drops off slightly in a somewhat linear fashion until time $T_2$ is reached for initiation of the overall cycle with a turn on of transistor Tr.

Referring now to FIG. 2B, such represents the voltage signal across lines 70 and 80. As transistor Tr is turned "on" at $T_0$, the voltage of capacitor $C_2$ is of reverse polarity when taken with respect to the return path of power supply source 14. An approximate negative 70.0 volts representing the maximum voltage of the half-wave power supply from diode $D_1$ is applied across gas discharge tube 12 at this time. Capacitor $C_2$ discharges through gas discharge tube 12 during the time $T_0$ to $T_1$ and the voltage rises to approximately a minus 60.0 volt level. As transistor Tr turns "off" at $T_1$, capacitor $C_2$ is reversed and begins to charge again.

Referring to FIG. 2C, such directs itself to the representation of the voltage waveform between base 44 and emitter 42 of transistor Tr. At $T_0$, the base emitter voltage is approximately 1.0 volts positive which is the voltage necessary to turn transistor Tr into an "on" state through the interval of $T_0$–$T_1$. At $T_1$, the voltage in secondary winding 24 goes negative, which turns the transistor Tr into an "off" state. There is a rise in the voltage to a minus 1.5 volts as the flow path passes the current through diode $D_2$. Thus, base 44 is at a minus 1.5 volts during the transistor "off" period, as a negative voltage.

Referring now to FIG. 2D, such is a representation of the current passing through the primary circuit as hereinbefore described, and substantially represents the line current through the primary circuit, as has hereinbefore been described. This Figure provides for the line current waveform as on transformer input line 36, as shown in FIG. 1. This provides for a typical current charge/discharge of capacitor $C_2$. Capacitor $C_2$ discharges during the time period between $T_0$ and $T_1$ which is the time within which capacitor $C_2$ is discharging into gas discharge tube 12. A charging occurs between times $T_1$ and $T_2$ and this time interval represents the "off" state of transistor Tr.

Referring now to FIG. 2E, the positive portion of the current waveform represents the base current of transistor Tr, and at the time of turning "on" the transistor at $T_0$, a positive current is provided. The current goes negative at time $T_1$ which represents the current in the secondary circuit flowing through diode $D_2$.

FIG. 2F is the differentiated voltage signal across filament 32 of gas discharge tube 12. The voltage is a differentiated function due to the action of capacitor $C_3$, and is 180° out-of-phase with the voltage in the base-emitter junction as is seen in FIG. 2C. This occurs due to the fact that it is on the opposing side of secondary winding 24.

FIG. 2G represents the current waveform through the plasma of tube 12. The negative current is produced only during transistor Tr turned "on" states.

Referring now to FIGS. 1 and 2, there is provided a method of producing light output from gas discharge or fluorescent tube 12 having first and second filaments 30 and 32 contained therein. Capacitor $C_2$ is charged during the time interval $T_2$ minus $T_1$, as is shown in FIG. 2D, on Graph Line 100. As has been previously described, first capacitor $C_2$ is coupled to first filament 30 through line 70 and is in series coupling to primary winding 22 of transformer T, as well as collector 38 of transistor Tr.

During the time interval $T_0$ to $T_1$, first capacitor $C_2$ discharges the stored energy into first filament 30 through line 70. Discharging of first capacitor $C_2$ is shown on graph line 102 of FIG. 2D. Responsive to discharge of first capacitor $C_2$, it is seen from FIG. 2B that there is a voltage across the load defined by first filament 30, tube 12, and second filament 32 of an initial voltage drop 104 at $T_0$ and a corresponding voltage increase as shown by line 106 at $T_1$. During the time interval between $T_1$ and $T_2$, there is a generally linear drop off of load voltage shown by line 108 of FIG. 2B.

During the initial phases of capacitor $C_2$ drop-off, as shown by graph lines 102, there is simultaneously generated a pulse voltage signal in secondary winding 24 of transformer T having a first polarity. The first polarity is shown by current spike 122 of FIG. 2E. As can be seen, current spike or pulse 122 of first polarity occurs at the initiation of the portion of the overall cycle between times $T_0$ and $T_1$. Current spike 122 having the first polarity is applied to base 44 of transistor Tr which drives transistor Tr to a conducting state. Thus, collector 38 and emitter 42 are electrically coupled and there is a electrical flow path therebetween as shown by graph line 112 of FIG. 2A showing the voltage drop between collector 38 and emitter 42. During the time interval $T_0$ to $T_1$, the voltage drop between collector/emitter of transistor Tr is approximately 0.5 volts.

Correspondingly, the voltage drop between base 44 and emitter 42 of transistor Tr approximates 1.0 volts during time interval $T_0$ to $T_1$, as shown by graph line 114 of FIG. 2C.

At time $T_1$, first capacitor $C_2$ begins to charge as shown by graph line 100 of FIG. 2D. Simultaneously, at the beginning of time interval $T_1$ to $T_2$, second pulse current spike 124 is produced having a second polarity which is opposite in polarity to first polarity voltage 122, as is shown in FIG. 2E. Additionally, FIG. 2F directs itself to voltage pulses applied to filament 32 as a result of the differentiation of the voltage pulse from secondary winding 24 by capacitor $C_3$ providing a swing between approximately plus and minus 6.0 volts of pulses 110 and 116.

Initiation of second polarity current spike 124 causes transistor Tr to be driven to a non-conducting state as shown by graph lines 118 of FIG. 2A where the voltage drop between collector 38 and emitter 42 is driven to approximately 170 volts at the beginning of the time interval between $T_1$ and $T_2$. Correspondingly, as shown in FIG. 2C, the voltage drop between base 44 and emitter 42 is slightly less than 0.0 volts, as shown by graph line 120. This has the effect of turning transistor Tr to a non-conducting state and as shown in FIG. 1, diode $D_2$ becomes conducting.

FIG. 2E directs itself to the current spikes applied to base 44 and provides for polarity spikes 122 and 124 of opposite polarity to the voltage spikes, as shown in FIG. 2F. Additionally, FIG. 2G directs itself to current in line 70 being input to filament 30, and shows a swing generally between 100 and minus 110.00 ma., as shown by graph line 126 and 128.

Thus, there is provided the initial discharging of first capacitor $C_2$ as evidenced by the graph lines 102 wherein first capacitor $C_2$ is coupled to first filament 30 on one end thereof. Secondly, there is a charging of first capacitor $C_2$ as shown by graph lines 100 where said charge is input to first capacitor of gas discharge tube 12.

It is to be understood that the association of gas discharge tube 12 with primary winding 22 of transformer T and capacitor $C_2$ of electronic ballast system 10 obviates the requirement of a third winding on transformer T devoted to supply the desired voltage across gas discharge tube 12. The DC energy taken from the source is equal to the square root of the time interval $T_1$-$T_0$ divided by the time interval $T_2$-$T_0$. Thus, the use of system 10 provides the ability of having a duty factor of 25.0% or less resulting in avoiding unwanted dissipation in transistor Tr and further minimizes energy consumption to 50.0% or less than in prior art systems. The minimization of transistor dissipation and energy consumption is provided without the introduction of large fluctuations in light intensity nor the interruption of light emission during any cycle thus, negating any light flicker.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. An electronic ballast system connected to an AC power source for a gas discharge tube having a first and second filament, comprising:

(a) a first capacitor electrically coupled in series to said first filament of said gas discharge tube;

(b) a transistor having a base, emitter, and collector, said collector being connected to said first capacitor; and, (c) transformer means having a primary winding coupled on a first end to said AC power source and on a second end to said first capacitor and said collector of said transistor, and a secondary winding coupled on opposing ends thereof in positive feedback relation to said base of said transistor and said emitter of said transistor, said primary winding being coupled in series relation with a parallel combination of (1) said emitter and collector of said transistor, and (2) said series coupled first capacitor and said gas discharge tube.

2. The electronic ballast system as recited in claim 1 including means for applying a pulse voltage to said second filament of said gas discharge tube.

3. The electronic ballast system as recited in claim 2 where said means for applying said pulse voltage includes means for providing said pulse voltage to said second filament of said gas discharge tube.

4. The electronic ballast system as recited in claim 3 where said pulse voltage means includes a second capacitor in series connection with said secondary winding of said transformer means and a first end of said second filament of said gas discharge tube.

5. The electronic ballast system as recited in claim 4 where said second filament second end is coupled to a return side of said AC power source, and said emitter of said transistor.

6. The electronic ballast system as recited in claim 1 including a second diode coupled in parallel relation to said emitter and said base of said transistor.

7. The electronic ballast system as recited in claim 1 where said transistor is an NPN transistor element.

8. The electronic ballast system as recited in claim 1 including means for rectifying said AC power source voltage being input to said primary winding of said transformer.

9. The electronic ballast system as recited in claim 8 where said AC power source voltage input to said primary winding of said transformer is half-wave rectified.

10. The electronic ballast system as recited in claim 8 where said means for rectification includes a first diode coupled to said AC power source in series relation.

11. The electronic ballast system as recited in claim 10 including filter means connected in parallel to said first diode and a return line of said AC power source.

12. The electronic ballast system as recited in claim 1 where said transformer means is a ferrite core transformer.

13. The electronic ballast system as recited in claim 11 where said transformer is phased in a manner wherein when a voltage increase is applied to said collector of said transistor, a voltage of opposite polarity is applied to said base of said transistor.

14. The electronic ballast system as recited in claim 1 where said first capacitor has a capacitance value approximating 0.050 microfarads.

15. The electronic ballast system as recited in claim 4 where said second capacitor has a capacitance value approximating 0.050 microfarads.

16. The electronic ballast system as recited in claim 11 where said filter means has a capacitance value approximating 100.0 microfarads.

17. An electronic ballast system connected to a power source having an output line and a return line for a gas discharge tube having a first and second filament, comprising:

(a) primary circuit means for providing (1) a discharge current through said gas discharge tube between said first and second filaments, and, (2) a charging current into a capacitor coupled in series with said first filament for discharge of said current into said gas discharge tube, said primary circuit means including a primary winding of a transformer, said primary winding being electrically coupled on a first end to said capacitor and a collector of a transistor element and on a second end to said power source; and, (b) secondary circuit means for actuating and deactuating said primary circuit means for control of discharge in said gas discharge tube with differentiated current pulses, said secondary circuit means including a secondary winding of said transformer, said secondary winding being coupled on opposing ends thereof to said second filament and the base of said transistor element.

18. The electronic ballast system as recited in claim 17 where said primary circuit means includes a first capacitor coupled on a first end in series to said primary winding and a collector of said transistor element and on a second end to said first filament of said gas discharge tube.

19. The electronic ballast system as recited in claim 18 where said secondary circuit means includes a second capacitor coupled in series between said secondary winding of said transformer and said second filament of said gas discharge tube.

20. The electronic ballast system as recited in claim 19 where said secondary winding of said transformer is coupled to the base of said transistor element in feedback relation from said second filament to said transistor element.

21. The electronic ballast system as recited in claim 20 including a second diode element connected in parallel between said emitter and said base of said transistor element.

22. The electronic ballast system as recited in claim 17 including means for rectifying voltage on said output line of said primary circuit means.

23. The electronic ballast system as recited in claim 22 where said means for rectifying voltage includes means for half-wave rectification of said AC power source voltage on said output line.

24. The electronic ballast system as recited in claim 23 where said half-wave rectification means includes a first diode coupled to said AC power source in series relation.

25. The electronic ballast system as recited in claim 24 including filter means connected in parallel to said first diode output line and said return line of said AC power source.

26. The electronic ballast system as recited in claim 17 where said transformer is a ferrite core transformer.

27. The electronic ballast system as recited in claim 26 where said transformer is phased to substantially simultaneously provide (1) a voltage having a first polarity applied to a collector of said transistor, and, (2) a voltage having a second polarity opposite to said first polarity to said base of said transistor.

28. The electronic ballast system as recited in claim 18 where said first capacitor has a capacitance value approximating 0.050 microfarads.

29. The electronic ballast system as recited in claim 18 where said transistor element is a NPN transistor.

30. The electronic ballast system as recited in claim 19 where said second capacitor has a capacitance value approximating 0.050 microfarads.

31. A method of providing light output from a gas discharge tube having a first filament and a second filament contained therein including the steps of:

(a) charging a first capacitor coupled to said first filament on one end thereof, said capacitor being coupled to a primary winding of a transformer and a collector of a transistor element on a second end thereof, said transistor element being in a non-conducting state;

(b) simultaneously inducing a pulse voltage signal having a first polarity from a secondary winding of said transformer;

(c) applying said first polarity pulse voltage signal to the base of said transistor element for driving said transistor element to a conducting state;

(d) discharging said first capacitor to said first filament;

(e) simultaneously passing collector current of said transistor element through said primary winding and inducing a second polarity pulse voltage signal in said secondary winding;

(f) applying said second polarity pulse voltage to said base of said transistor element for driving said transistor element to a non-conducting state;

(g) inducing a voltage signal in said primary winding responsive to said transistor element being switched to said non-conducting state; and, (h) applying said voltage to said first capacitor for simultaneously (1) charging said first capacitor and (2) passing said voltage signal across said gas discharge tube.

32. The method of providing light output as recited in claim 31 where the step of charging said first capacitor includes the step of applying a pulsating DC current to said first capacitor.

33. The method of providing light output as recited in claim 32 where the step of applying said pulsating DC current includes the step of rectifying current provided on AC power source.

34. The method of providing light output as recited in claim 33 where the step of charging said first capacitor includes the step of passing said rectified current through said winding of said transformer.

35. The method of providing light output as recited in claim 34 where the step of simultaneously inducing said pulse voltage includes the step of developing said pulse voltage in said secondary winding of said transformer.

36. The method of providing light output as recited in claim 35 where the step of developing said pulse voltage includes the step of coupling said secondary winding to a differentiating capacitor in series connection with said second filament of said gas discharge tube.

* * * * *